US009238228B2

(12) United States Patent
Anttila et al.

(10) Patent No.: US 9,238,228 B2
(45) Date of Patent: Jan. 19, 2016

(54) CONE CRUSHER AND PROCESSING PLANT FOR MINERAL MATERIAL

(75) Inventors: Kimmo Anttila, Pirkkala (FI); Antti Harju, Tampere (FI); Kari Kuvaja, Tampere (FI); Aki Lautala, Tampere (FI); Mika Peltonen, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 179 days.

(21) Appl. No.: 13/391,859

(22) PCT Filed: Apr. 13, 2011

(86) PCT No.: PCT/FI2011/050318

§ 371 (c)(1),
(2), (4) Date: Nov. 6, 2012

(87) PCT Pub. No.: WO2012/140307

PCT Pub. Date: Oct. 18, 2012

(65) Prior Publication Data

US 2014/0021280 A1 Jan. 23, 2014

(51) Int. Cl.
*B02C 2/04* (2006.01)
*B02C 21/02* (2006.01)

(52) U.S. Cl.
CPC ..... *B02C 2/047* (2013.01); *B02C 21/026* (2013.01)

(58) Field of Classification Search
CPC ..... B02C 2/04; B02C 2/042; B02C 21/02; B02C 2/047
USPC ..... 241/207–216
See application file for complete search history.

(56) References Cited

U.S. PATENT DOCUMENTS

| | | | |
|---|---|---|---|
| 3,417,932 | A | 12/1968 | Patterson |
| 3,532,277 | A | 10/1970 | Decker et al. |
| 3,539,119 | A | 11/1970 | Cook |
| 3,873,037 | A | 3/1975 | Decker et al. |
| 6,648,255 | B2 | 11/2003 | Martinez, Jr. et al. |
| 7,699,253 | B2 | 4/2010 | Niklewski |

FOREIGN PATENT DOCUMENTS

| | | | |
|---|---|---|---|
| EP | 1 843 851 | B1 | 4/2010 |
| FR | 2 530 495 | A1 | 1/1984 |
| GB | 1130248 | | 10/1968 |
| WO | 2009/066001 | A1 | 5/2009 |
| WO | 2010/086488 | A1 | 8/2010 |

OTHER PUBLICATIONS

PCT International Search Report and Written Opinion dated Apr. 13, 2011.

*Primary Examiner* — Mark Rosenbaum
(74) *Attorney, Agent, or Firm* — Andrus Intellectual Property Law, LLP

(57) ABSTRACT

A cone crusher having a frame, an outer blade adapted to be locked to the frame, an inner blade eccentrically and vertically movable relative to the outer blade, and the inner blade and the outer blade define there between a crushing chamber, a main shaft which is stationary relative to the frame, an eccentric bearing-mounted on the main shaft, a support cone on which the inner blade is arranged, and an adjustment shaft by means of which the support cone is vertically movable from below. A hollow space is arranged inside the main shaft, the adjustment shaft is arranged to the hollow space, a load cylinder is arranged to a lower end of the main shaft which load cylinder comprises an adjustment piston acting to a lower end of the adjustment shaft, a pressure medium supply is arranged to a pressure volume under the adjustment piston for moving vertically the adjustment shaft, and a lubricant supply is arranged above the adjustment piston for directing lubricant via the hollow space to targets to be lubricated. The main shaft is fixed stationary to the frame such that the lower end of the main shaft extends outside the frame under the frame and that the lubricant supply is arranged from outside to the outside extending part of the main shaft and through the main shaft to the hollow space.

13 Claims, 4 Drawing Sheets

CONE CRUSHER AND PROCESSING PLANT FOR MINERAL MATERIAL

TECHNICAL FIELD

The invention relates to a cone crusher which comprises an outer blade and an inner blade which is movable within the outer blade and which cone crusher is suitable for mineral material crushing. The invention relates particularly, though not exclusively, to a cone crusher having an inner blade which is movable in vertical direction by means of an adjustment shaft located within a main shaft of the crusher. Further the invention relates to a processing plant which comprises a cone crusher.

BACKGROUND ART

In a gyratory and cone crusher a relative position of an inner wear part to an outer wear part is brought closer by adjusting the inner blade upwards or the unloaded outer blade downwards.

In known solutions a significant increase of height of the crusher is disadvantageous when an adjustment distance is enlarged. The height increase of a whole crushing plant is disadvantageous when the height of the construction increases, what, among others, complicates feed of material and, for example, transport of movable crushing apparatuses. Increase of weight of the construction is also disadvantageous when the height of the construction increases. Long radial bearings are needed in the adjustment direction when an adjustment of a setting is made by means of the inner blade of the cone crusher. It is not possible to adjust dynamically the setting of the crusher by adjusting the outer blade when the crusher is loaded.

EP 1843851 B1 shows several cone crushers in which a crushing chamber is formed between a stationary outer blade and a movable inner blade. The inner blade of the crusher shown in FIG. 5 of document EP 1843851 B1 is mounted on a support cone which is bearing-mounted by means of a first radial bearing outside an eccentric. Crushing force is produced to the crushing chamber by moving the inner blade radially through the eccentric. A portion of a frame of the crusher is forming a stationary main shaft and the eccentric is bearing-mounted inside the eccentric on an outer surface of the main shaft by means of a second radial bearing. A vertically movable adjustment shaft is mounted through the frame of the crusher and the eccentric, the upper end of which adjustment shaft is actuating to the support cone through a thrust bearing. A load cylinder which is acting in vertical direction is arranged to the lower end of the adjustment shaft for vertical movement of the inner blade. Lubricant for the crusher is fed through a pressure volume and a piston of the load cylinder to the adjustment shaft and further via flow channels arranged inside the adjustment shaft to lubrication targets inside the crusher frame. The outer blade is locked stationary to the cone crusher frame during the loading. The outer blade is adjustable relative to the cone crusher frame during stop of the crusher, before loading.

An object of the invention is to create a cone crusher in which the flow of the lubricant is implemented in an alternative way. A particular object is to enhance adjustability and usability of the cone crusher. A particular object is to create a cone crusher in which dynamic adjustability of the setting is enhanced. A particular object is to create a cone crusher having a simple construction. A particular object is to lighten the cone crusher, particularly the frame. A particular object is to lower the construction of the cone crusher. A particular object is to reduce amount of machining to be made to the frame.

SUMMARY

According to a first aspect of the invention there is provided a cone crusher comprising

- a frame,
- an outer blade which is adapted to be locked to the frame,
- an inner blade which is eccentrically and vertically movable relative to the outer blade, and the inner blade and the outer blade define there between a crushing chamber,
- a main shaft which is stationary relative to the frame,
- an eccentric which is bearing-mounted on the main shaft,
- a support cone on which the inner blade is arranged,
- an adjustment shaft by means of which the support cone is vertically movable from below,
- and
- a hollow space is arranged inside the main shaft,
- the adjustment shaft is arranged to the hollow space,
- a load cylinder is arranged to a lower end of the main shaft which load cylinder comprises an adjustment piston acting to a lower end of the adjustment shaft, a pressure medium supply is arranged to a pressure volume under the adjustment piston for moving vertically the adjustment shaft, and
- a lubricant supply is arranged above the adjustment piston for directing lubricant via the hollow space to targets to be lubricated, preferably to upper portions of the main and adjustment shafts.

Preferably the main shaft is fixed stationary to the frame such that the lower end of the main shaft extends outside the frame under the frame and that the lubricant supply is arranged from outside the main shaft through the main shaft.

Preferably the main shaft is fixed stationary to the frame such that the lubricant supply is arranged via the load cylinder.

Preferably the load cylinder comprises an adjustment valve and additionally an optional overload protection which is/are coupled directly in connection with the pressure volume of the load cylinder.

Preferably a thrust bearing is arranged between an upper end of the adjustment shaft and the support cone.

Preferably an anti-spin brake is arranged between the upper end of the adjustment shaft and the support cone, inside the upper end of the adjustment shaft.

Preferably a locking means is arranged to the hollow space between the adjustment shaft and the main shaft which locking means allows the vertical movement of the adjustment shaft relative to the main shaft.

Preferably flow channels and/or flow grooves are arranged to the main shaft, the adjustment shaft and radial bearings comprised by the cone crusher for directing lubricant from the hollow space to the lubrication targets.

Preferably the load cylinder comprises a cylinder sleeve which is attached to the lower end of the main shaft and a cylinder chamber is formed in the cylinder sleeve inside walls of the cylinder, in which cylinder chamber the adjustment piston is adapted to be moved vertically, and the cylinder chamber is open to the hollow space above the adjustment piston and the cylinder sleeve is reduced in thickness from outside for supplying lubricant from outside the thinned cylinder sleeve to the hollow space.

Preferably the load cylinder comprises a cover which is closing the cylinder chamber under the adjustment piston, and a pressure medium supply channel is arranged to the cover.

Preferably the cone crusher comprises means for adjusting vertically the position of the outer blade relative to the frame.

Preferably the cone crusher comprises a thread for the vertical adjustment of the outer blade which thread comprises an inner thread arranged on side of the frame and an outer thread arranged on side of the outer blade, and an angle of the cross section profile of the thread is selected such that contact surfaces of the inner and outer threads via which crushing force is transferred to the frame and which are perpendicular relative to a force resultant of the crushing event.

According to a second aspect of the invention there is provided a mineral material processing plant comprising a cone crusher according to the first aspect or according to any above embodiment.

Preferably the processing plant is a fixed plant, an independent movable plant or a plant which is transportable on road.

Further preferable embodiments and advantages of the invention are shown in the following description and claims.

Different embodiments of the present invention will be illustrated or have been illustrated only in connection with some aspects of the invention. A skilled person appreciates that any embodiment of an aspect of the invention may apply to the same aspect of the invention and other aspects alone or in combination with other embodiments as well.

BRIEF DESCRIPTION OF THE DRAWINGS

The invention will be described, by way of example, with reference to the accompanying drawings, in which.

DETAILED DESCRIPTION

In the following description, like numbers denote like elements. It should be appreciated that the illustrated drawings are not entirely in scale, and that the drawings mainly serve the purpose of illustrating some example embodiments of the invention.

Figure 1:
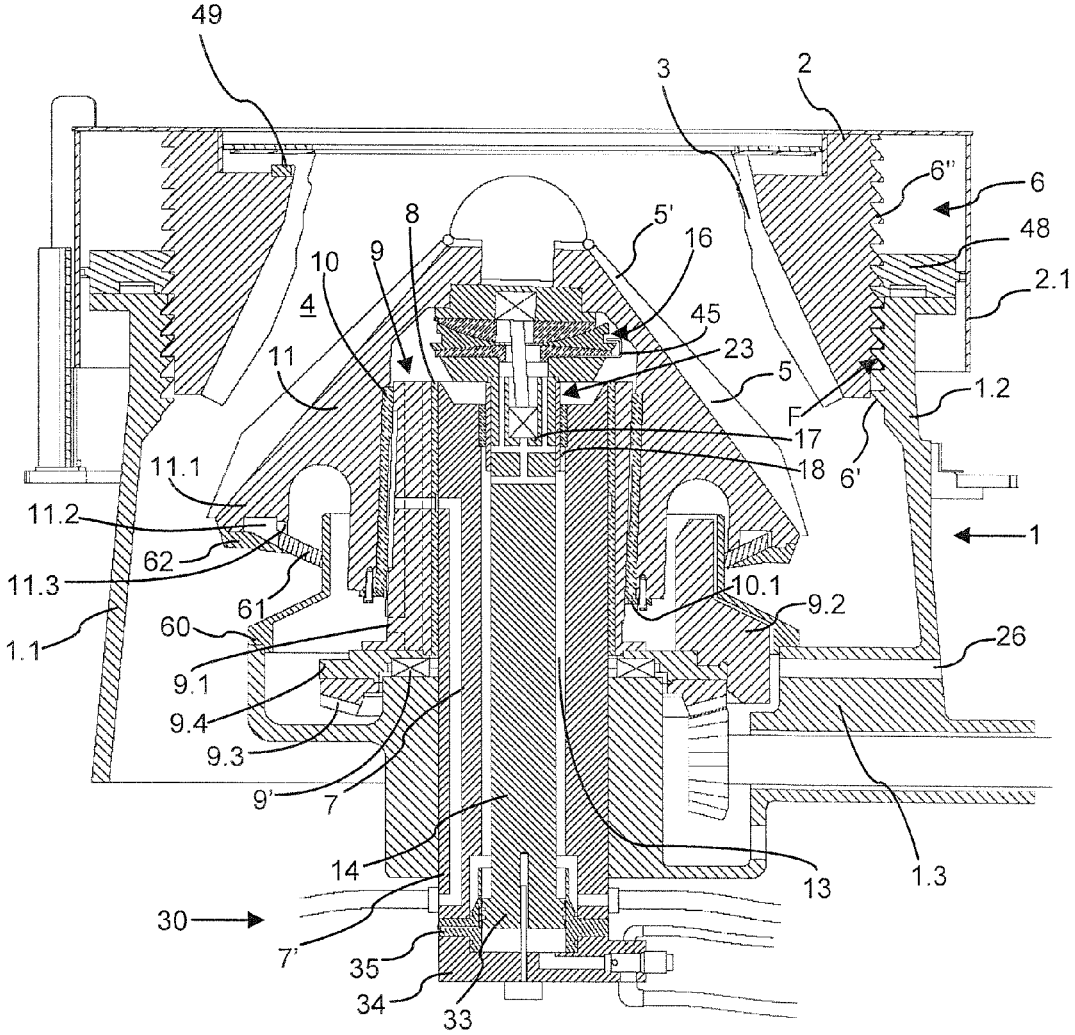
FIG. 1 shows a cone crusher according to a preferable embodiment of the invention.

FIG. 1 shows a cone crusher comprising a frame 1 and an upper part 2 of the crusher attached to the frame, to which upper part is attached an outer blade 3 of the crusher. The outer blade can be moved vertically when a crushing chamber 4 is not loaded.

The crushing chamber 4 of the cone crusher is formed between the outer blade 3 and an inner blade 5. In the crushing event, the position of the inner blade 5 is changed relative to the outer blade 3, preferably as a combination of a radial movement and a circulating movement of an axis of the inner blade. Optionally or additionally, the inner blade 5 may be moved vertically during the crushing or in an unloaded state, a so called idle state, simultaneously or at different times with the outer crushing blade.

The outer blade 3 is, under loading, stationary relative to the frame 1 and in the unloaded state the outer blade can be moved vertically relative to the frame by rotating the upper part 2 of the crusher supported on threads 6. The frame 1 comprises a vertical outer shell 1.1 having up at its upper portion 1.2 an inner thread 6', and an outer thread 6" is on an outer periphery of the upper part 2 of the crusher. The outer blade is fixed to the upper part, for example, by means of a wedge locking 49 by mounting a wedge between an edge of the upper part 2 and a lug of the outer crushing blade 3.

In FIG. 1 a lower end of the upper part 2 of the crusher is ending on same level relative to a lower edge of the outer blade 3. Particularly, when crushing with large settings and new blades the upper part 2 can be rotated in its highest position wherein it is preferable to produce the lower edge of the upper part 2 to continue so down that also in such a situation the lower edge of the upper part 2 is protecting the outer thread 6' of the outer shell 1.2 of the frame and preventing rock material and dust created in connection with crushing from entering to the threads 6.

Adjustment of the position of the outer blade 3 is preferably implemented by the thread 6 in which an angle of the cross section profile is selected such that contact surfaces of the inner and outer threads are pressed against each other when a locking means 48 is locking the upper part 2 to the frame 1.2 in a way known per se. The contact surfaces are perpendicular relative to a force resultant F of the crushing event in the crushing chamber 4. Then the contact surfaces of the threads are not able to move (among others, because of deflections in material and backlashes) during crushing relative to each other and wear is reducing. Also moving the contact surfaces of the thread relative to each other is easier after the locking because the contact surfaces are not sticking to each other. The angle of the thread can be defined on application basis and the angle may be between 50-60 degrees relative to horizontal plane. Preferably in the case of the crusher according to the invention the angle is 53 to 57 degrees, most preferably the angle is 55 degrees.

Support of the inner blade 5 of the crusher and of a transmission and loading mechanism of the inner blade within the outer shell 1.1 is implemented by one or more arms 1.3 extending radially inwards from the outer shell 1.1.

A main shaft 7 is attached to the frame 1. The main shaft is fixed non-rotatable to the frame preferably by pressing the frame around the main shaft, or by a thread, wedges or a cone. The main shaft is preferably tube-like. An eccentric 9 is bearing-mounted by means of an inner radial bearing 8 to the main shaft 7, more particularly to an upper end, above the frame, of the main shaft. The eccentric which is generally denoted by reference number 9 comprises preferably as main parts an eccentric bushing 9.1 to be bearing-mounted on the main shaft 7, a counterweight 9.2, a gear 9.3 and a bottom plate 9.4 to which other parts are attached. Amount of stroke can be changed when the eccentric bushing and the counterweight, which are formed as independent parts, are changed to different sized parts.

The inner radial bearing 8 is coaxial with a centre line of the crusher defined by the outer blade of the crusher. An outer radial bearing 10 (fixed to a support cone 11) is arranged outside the eccentric 9, a centre line of which outer radial bearing is in angled position relative to the centre line of the crusher. The inner blade 5 is mounted on the support cone 11 which is bearing-mounted by means of the outer radial bearing 10 on the eccentric 9. The support cone is bearing-mounted on the eccentric preferably in a position which is inclined in relation to a rotation axis of the main shaft. A vertical lower thrust bearing 9' for the eccentric is located between the eccentric and the frame. When the eccentric 9 is rotated from outside the crusher through a drive shaft, the inner blade 5 is moving in the crushing chamber 4 eccentrically in a way known per se.

The frame 1 of the cone crusher can be made simpler than known frames because the inner radial bearing 8 to be formed for the eccentric 9 is mounted to the main shaft 7 formed as a separate component from the frame 1, and not mounted to forms machined in the frame (for example, so that the frame and the main shaft were made as one piece). Because the main shaft can be handled better than the frame, forms required by bearings and lubrication, for example, lubrication flow channels, are easier to manufacture to the main shaft. Getting the forms of the frame 1 simpler enables making the frame in one piece more cost-effective by casting than before. Machining required to the frame 1 for the main shaft 7 can be simpler than before what reduces costs and production time needed for the manufacture.

A hollow space 13, which is directed along the direction of the main shaft, is formed inside the main shaft 7, preferably through the main shaft. An adjustment shaft 14 is arranged into the hollow space of the main shaft. The hollow space 13 formed between the main shaft 7 and the adjustment shaft 14 is forming a flow channel for supplying lubricant to upper portions of the main and adjustment shafts. Machining of a separate lubrication oil channel to the adjustment and main shafts can so be avoided.

Figure 2:
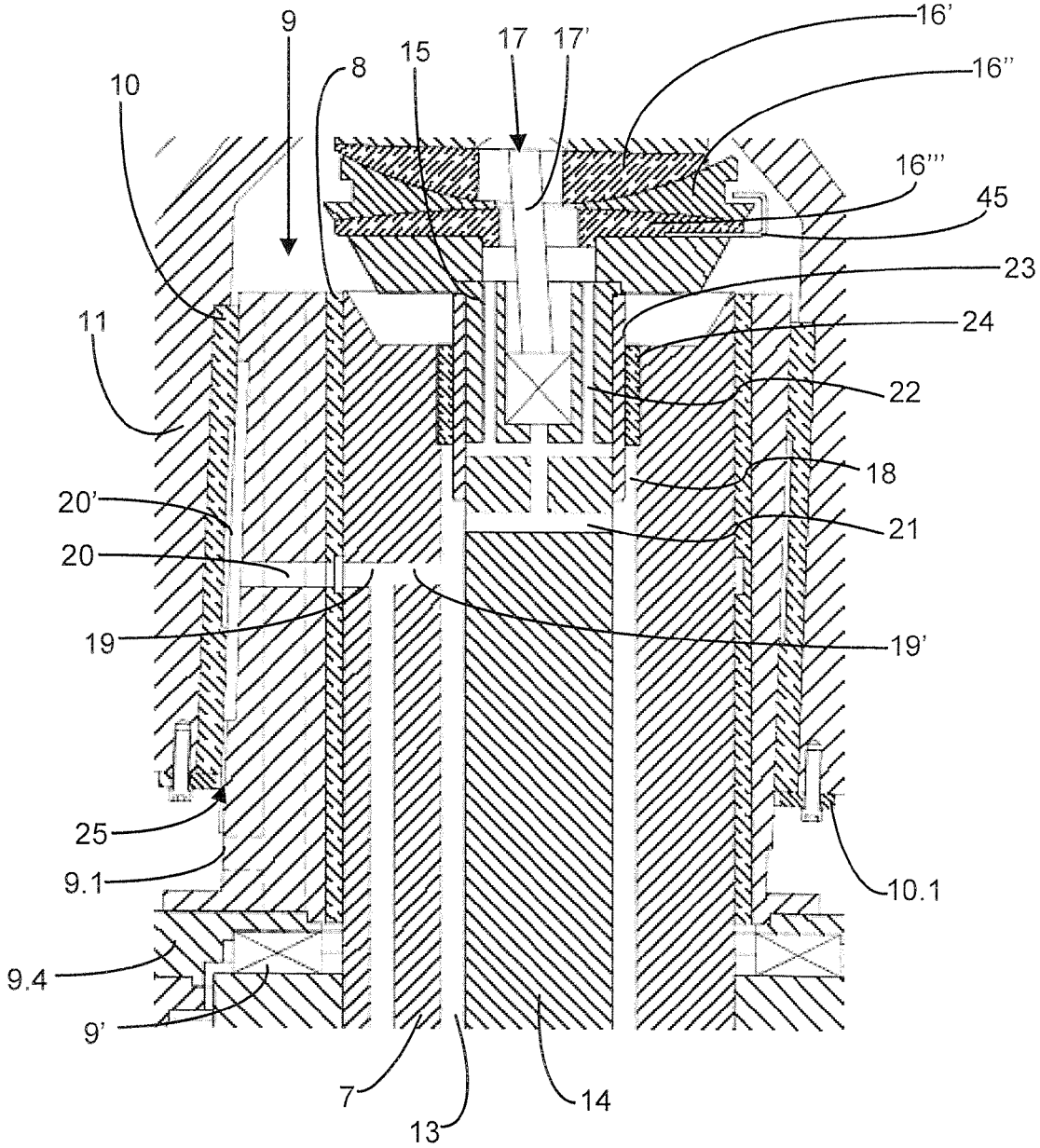
FIG. 2 shows a flow arrangement for lubricant in connection with an upper portion of a main shaft of the cone crusher of FIG. 1.

FIG. 2 shows more precisely how an upper end 15 of the adjustment shaft 14 is arranged to act vertically through a thrust bearing 16 to the inner blade 5 supported by the support cone 11. The thrust bearing 16 is arranged between the upper end 15 of the adjustment shaft and the support cone 11. An anti-spin brake 17 is arranged inside the upper end 15 of the adjustment shaft 14 for preventing unintentional rotation of the inner blade 5 in the unloaded state. The anti-spin brake comprises a friction coupling between the adjustment shaft 14 and the support cone 11 and preferably a one-piece rigid transmission bar 17' which is passing through loose-fitting openings centrally in the thrust bearing. A mechanism which is coupling the transmission bar to the anti-spin brake and/or to the support cone is preferably of constant speed type, and has an analog function with, for example, a drive pivot used in drive shafts of vehicles.

A locking means 18 is arranged in the hollow space 13, which acts as a lubrication oil channel, between the main and adjustment shafts, for example, a wedge locking which prevents rotation movement of the main and adjustment shafts relative to each other but enables a vertical movement of the adjustment shaft. The structure of the locking means saves wear of seals of an adjustment piston 33 of a load cylinder 30 (FIG. 3), enables mounting of the anti-spin brake 17 into the adjustment shaft 14 and improves function of the thrust bearing 16.

FIG. 2 shows a flow arrangement for lubricant in connection with the upper portions of the main shaft 7 and the adjustment shaft 14. As lubrication targets in the upper portions of the main and adjustment shafts are, among others, the inner radial bearing 8 between the main shaft and the eccentric, the outer radial bearing 10 between the eccentric and the support cone, the anti-spin brake 17 and the thrust bearings 16, 9'.

Flow channels (for example, holes) are preferably arranged to the main shaft and the adjustment shaft for directing lubricant to targets which are needing lubrication such as to the thrust and radial bearings. The flow of lubricant to separate targets can be adjusted and an exact amount of lubricant can be achieved directly to desired targets by changing relative size and amount of the flow channels.

A separate channel 19, formed inside the main shaft 7, is directed to the inner radial bearing 8. Optionally or additionally to the above, one or more first flow channels 19' can be lead from the hollow space 13 to the inner radial bearing 8. One or more second flow channels 20 can be lead further from the inner radial bearing 8 through the eccentric bushing to the outer radial bearing 10. Lubrication flow channels passing through the radial bearings can be located relative to each other on same or separate levels wherein flow distribution of lubricant to the bearings can be adjusted by means of the locating of the flow channels.

Pressure/flow of the lubricant to lubricated targets can be adjusted, in a lubricant space above the adjustment piston, by changing relative diameter ratios of the adjustment piston and the adjustment shaft (lower portion), and adjustment shaft and main shaft (upper portion), for example, when the adjustment shaft 14 is moved downwards.

One or more third flow channels 21 can be lead from the hollow space 13 to inside the upper end 15 of the adjustment shaft 14 and further, inside the upper end of the adjustment shaft, upwards to the anti-spin brake 17. One or more fourth flow channels 22 can be lead from the third flow channel 21 (or direct from the hollow space 13) to inside the upper end of the adjustment shaft, outside the anti-spin brake 17 to above the anti-spin brake 17 and further to the thrust bearings 16. Lubricant exiting the inner radial bearing 8 is lubricating preferably the lower thrust bearing 9' between the eccentric and the frame. The lubricant may flow from the thrust bearings 16 via the radial bearings 8, 10 or along separate holes to an oil sump of the frame for exit.

A protecting sleeve 23 is preferably to arrange to the upper end 15 of the adjustment shaft, with which protecting sleeve, for example, superfluous holes left from drilling of the fourth flow channels 22 can be closed. The protecting sleeve 23 can be made of harder material than the adjustment shaft and, if desired, hardened separately. A big hardness difference between the protecting sleeve 23 and a surrounding bearing sleeve 24 reduces wear. The bearing sleeve 24 is intended for coaxial vertical movement of the adjustment shaft inside the upper end 15 of the main shaft. A worn protecting sleeve 23 can be changed without damaging the adjustment shaft.

At upper and lower zones of the inner radial bearing 8 and the outer radial bearing 10 and the eccentric bushing 9.1 are preferably formed corresponding inner chamfers and outer chamfers (so called idle chamfers) for the unloaded state of the inner blade or for the duration of the idle time of the support cone. The support cone and the eccentric bushing are positioning inclined relative to each other because of bearing backlash and centers of gravity on different heights, wherein chamfers made in same inclination angle in the radial bearings of the eccentric and the support cone are forming an even support surface and a precondition for creating a lubrication film.

Lubrication grooves 20' may be formed to the eccentric bushing 9.1 and/or the radial bearing 8 for dividing lubricant from the second flow channels 20 vertically to the outer radial bearing 10. Additionally, lubrication groove specific bypass grooves 25 can be formed to the eccentric bushing and/or the radial bearing 8 in order that impurities in the lubricant do not accumulate on bottom of the lubrication groove/grooves.

The outer radial bearing 10 mounted inside the support cone 11 is held flexible in place preferably by means of a fixing flange 10.1. Preferably intermediate pieces (for example, sleeves) are mounted under fixing bolts of the fixing flange which leave play between the fixing flange and a head of the fixing bolt. Such a floating fixing of the outer radial bearing allows deformations in the support cone and the bearing bushing due to loading of the crusher and thermal expansion and improves the lifetime of the support cone.

The thrust bearing 16 comprises a bearing part 16' of the support cone, a separate intermediate part 16" and a lower part 16''' attached to the upper end of the adjustment shaft 14. The intermediate part and the lower part are attached during use to each other by a particular fixing member 45 which is intended for detaching the intermediate part 16" from the bearing part 16' of the support cone, when the support cone is lifted away from its place, for example, in connection with service work. The intermediate part could in connection with the lifting stick to the upper part instead of the lower part 16''' so that it could, when dropping too early, cause a dangerous situation to service personnel. The fixing member comprises one or more pieces having, for example, a shape of the character c, which pieces can be mounted to the lower and/or intermediate parts, for example, on their outer periphery.

The fixing member can be mounted, for example, such that it is mounted fixed to the lower part but not in contact with the intermediate part during use of the crusher but first when the upper part is started to lift away from its place, wherein the intermediate part which is possibly stuck to the upper part is separated from the upper part due to the fixing member and stays on the lower part. The fixing member is made of steel or other corresponding material keeping its shape. The fixing member can also be applied with a gyratory type crusher in which a thrust bearing is located in a lower portion of a main shaft.

The inner lubricant space of the cone crusher, especially inside the support cone 11 and the frame 1, is overpressurized in order to prevent impurities from entering, for example, the dust created in the crushing event. Compressed air is lead to the lubricant space directly through the arm 1.3. An air channel 26 with a large cross-sectional area fits in the arm 1.3.

The upper part 2 of the crusher is preferably equipped with a dust shield 2.1. Thus, the thread 6 can be protected against impurities and it works better. The dust shield 2.1 is connected to a rotating mechanism of the outer blade 3 and sealed with an annular seal which is located between the upper part 1.2 of the frame and the dust shield or in the locking mechanism 48.

A sealing arrangement is arranged between the eccentric movable support cone 11 and the frame 1 comprising a collar 60 and a radial dust sealing 61 which is packing against the collar. The collar is attached to the frame around the eccentric 9 and the dust sealing is tensed by means of a fixing member 62 against a skirt 11.1, of the support cone. The dust sealing is allowed to move relative to the support cone wherein the distance between an outer edge of the dust sealing and the support cone is changing. An empty space 11.2 located behind the dust sealing is preferably connected by means of air channels 11.3 to the lubrication space (for example, grooves or holes in the skirt 11.1 of the support cone). Function of the sealing arrangement and especially contact of the dust sealing 61 to the collar 60 can be enhanced when local underpressure is prevented from forming behind the dust sealing.

Figure 3:
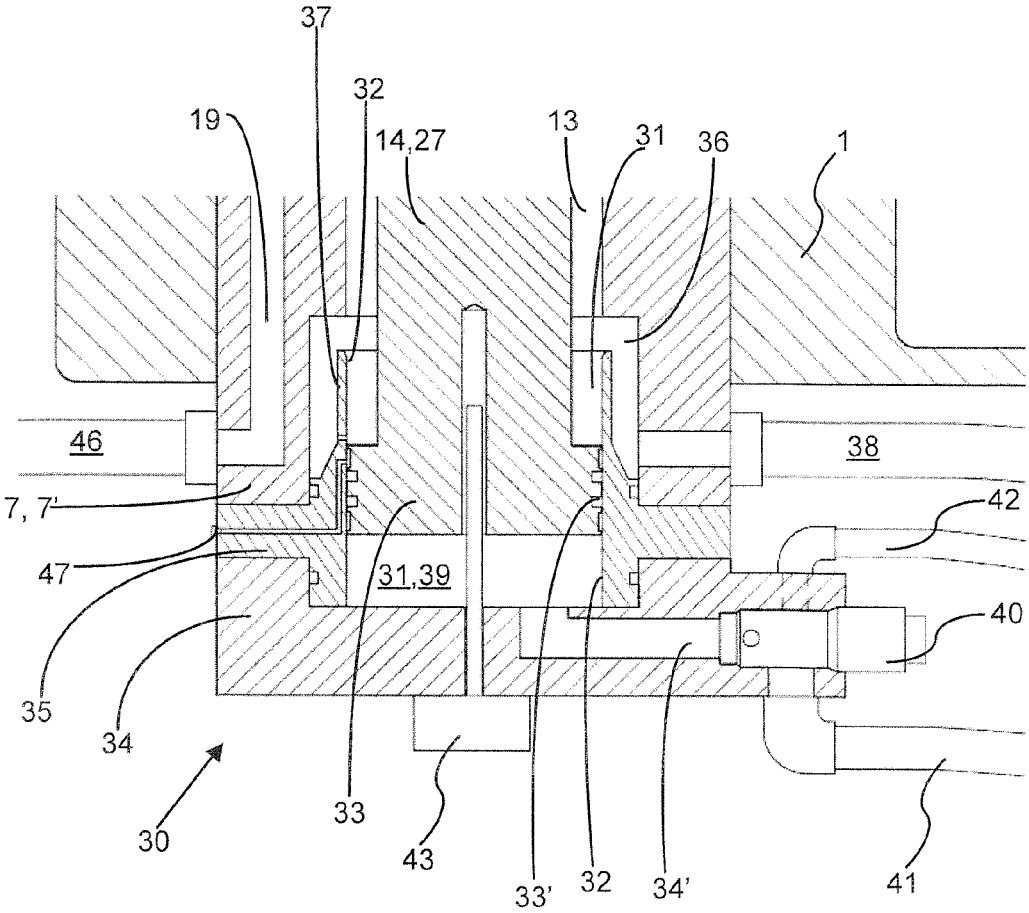
FIG. 3 shows a flow arrangement for lubricant and pressure medium in connection with a lower portion of the main shaft of the cone crusher of FIG. 1.

FIG. 3 shows a lubrication oil pass-through 46 via the channel 19 to the radial bearings of the crusher, a bleed channel 47 of a cylinder chamber 31 and the load cylinder 30 which acts vertically to a lower end 27 of the adjustment shaft 14 for the vertical movement of the inner blade 5.

The lower end 7' of the main shaft 7 is arranged to extend outside the frame 1 below the frame. This enables to arrange the lubricant supply and the load cylinder's 30 pressure medium supply directly in connection with the main shaft 7, without passing through the frame structure which is occurring in connection with known solutions. The main shaft can also be left within the frame and the lubrication channels can be lead from below the frame via and/or through a cover 34 and/or the cylinder chamber to the lubrication space 13.

The load cylinder 30 comprises a cylinder sleeve 35, attached to the main shaft 7, having a cylinder chamber 31 inside cylinder walls 32; the adjustment piston 33 which is vertically movable in the cylinder chamber; and the cover 34 which is closing the cylinder chamber from below. The adjustment piston 33 is supported from above to the lower end 27 of the adjustment shaft 14.

Under the adjustment piston 33 there is a cylindrical pressure volume 39 for the pressure medium such as hydraulic oil, and above the adjustment piston there is a cylindrical space for the lubricant. At least one sealing 33' is arranged between the adjustment piston 33 and the cylinder wall 32 for separating the lubrication oil and the adjustment oil from each other. Preferably two sealings are arranged to the adjustment piston of which the upper lubricant sealing is keeping the lubricant (which is, among others, dirtier than the pressure medium) separated from the below adjustment pressure sealing. The sealing of the adjustment piston 33 can also be implemented as a lubricant and adjustment pressure sealing having a combined structure.

The loading pressure of the load cylinder 30 is formed by leading pressure medium to the pressure volume 39. The pressure volume 39 is created by closing the cylinder chamber 31 from below with the cover 34 which is pressure sealed relative to the cylinder sleeve 35. A load adjustment valve 40 is attached to the cover 34, in direct connection with the pressure volume 39, via a short pressure medium supply channel 34'. So a supply pressure hose 41 connected to the load adjustment valve 40 does not form a portion of the pressure volume during the loading, and elasticity in the pressure hoses which is harming dynamic behavior of the crusher and is forming a safety risk to the operator is avoided.

The load adjustment valve 40 comprises preferably also, in connection with the pressurized space 39, a safety valve which is equipped with an overload protection. The load pressure can be released from the pressure volume 39 to an exit tube 42. The adjustment valve 40 can be used both to norm adjustment and as the safety valve, for example, in connection with a blockage which is causing overload in the crushing chamber. When a pressure sensor is also connected to the adjustment valve in connection with the safety valve, failure diagnostics of the loading hydraulics becomes easier because from an output of the safety valve can be deduced if the safety valve or any sealing in connection with the pressure volume 39 is leaking.

The cylinder sleeve 35 is fixed, for example, by means of a flange fastening to the lower end of the main shaft 7 and a gap between the main shaft and the cylinder sleeve is sealed. The cylinder walls 32 extend partly to the hollow space 13 between the main shaft 7 and the adjustment shaft 14, into a lower end of which hollow space there is formed a widening 36 for the cylinder sleeve 35. The cylinder chamber 31 opens to the hollow space 13 from above the adjustment piston 33. Cylinder walls 32 locating in a region of the widening 36 are preferably made thinner from outside 37.

The cover 34 and the cylinder sleeve 35 are detachable from the crusher as separate components or a single unitary component so that service and repair acts directed to the cylinder and the piston can be conducted manually from below the crusher. Additionally, the adjustment piston 33 may be implemented as a component which is attachable to the adjustment shaft 14 so that its replacement from below is enabled. Optionally the main shaft 7 may comprise a unitary lower part 7', 35, 34 which is made of a larger entirety so that for measures the adjustment shaft and the piston can be lifted away from above.

The lubrication flow can be lead directly inside the main shaft to the level of the cylinder chamber 31 due to the thinned structure of the cylinder walls 32, preferably in vertical direction even to the height of the adjustment piston 33 or below. A coupling of the lubrication hose 38 can be made directly to the main shaft 7 so that there is no need for a pass-through in the frame 1 and there is achieved a unitary and a long press-fit between the main shaft and the frame.

By the extending of the load cylinder 30 and especially the upwards elongated cylinder chamber 31 inside the main shaft 7, one can achieve a load cylinder with a long stroke, save in height of the crusher construction and lighten the cone crusher. When the adjustment piston 33 for the setting of the inner blade 5 is within the main shaft 7, a single part frame structure can be achieved. The single part frame structure connected to the adjustment of the setting of the outer blades makes the crusher lighter. The thinner made cylinder wall structure 32, 37 which is preferably arranged in the region of the widening 36 of the hollow space 13 inside the main shaft 7 enables a low crusher construction at the same time when the lubricant can be supplied from outside the frame 1 directly through a wall of the main shaft 7 or optionally from below through the cover and further there from via the cylinder sleeve or optionally via the cylinder sleeve via an edge of its flange.

A measuring sensor 43 is arranged under the adjustment piston 33 of the load cylinder 30 by means of which the setting of the crusher can be measured immediately centrally from below the piston. The sensor may also be located non-centrally relative to a central line of the adjustment piston.

According to some preferable embodiments a chamfer 5' is arranged at an upper zone of the inner crushing blade 5 such that the crushing chamber is widening at the chamfer 5'. The chamfer 5' increases a distance between the inner blade and the outer blade what is influencing in same direction to the crushing event as a prolonging of the crushing chamber but without an increase of the height and weight of the cone crusher.

The bleed channel 47 is a channel which is formed to the main shaft 7 or the cylinder sleeve by machining or by other means, the purpose of which is to remove air in the adjustment cylinder chamber 31, for example, in connection with an introduction or after a service operation. A valve of the bleed channel is opened, after that hydraulic oil is brought to the pressure volume 39 so long that a lower edge of the adjustment piston is above a lower edge of the bleed channel and preferably on the level of the upper edge. The hydraulic liquid and air bubbles locating eventually on a lower surface of the adjustment piston are traveling from the cylinder chamber to the bleed channel 47 and from there further away from the crusher.

Figure 4:
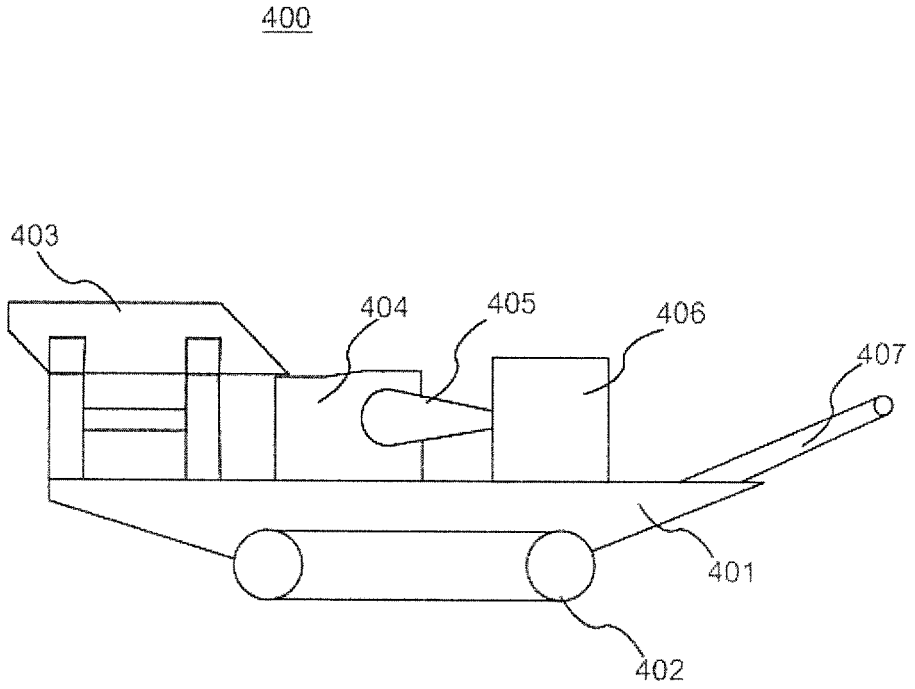
FIG. 4 shows a mineral material processing plant comprising the crusher according to FIG. 1.

FIG. 4 shows a mineral material processing plant 400 which is suitable, for example, for open pits for crushing rock material. The processing plant comprises a frame 401 to which is attached a track base 402 for enabling independent movement, a feeder 403 for feeding material to be crushed to a crusher 404 and a conveyor 407 for conveying crushed material further, for example, to a pile beside the processing plant. Additionally the crushing plant may comprise a power source 406 such as an electric, diesel or other type motor and a transmission 405 from the power source to the crusher 404.

The feeder 403 may be a lamella feeder or a lamella conveyor, a belt conveyor or a vibrating feeder which may also be scalping to separate fine material from the material to be crushed before crushing.

Instead of the track base 402 the movement may be enabled also, for example, by means of legs, skids or wheels. The processing plant 400 with a track base may be transported on the road on a carriage or a corresponding transport arrangement. Being wheel-based it can be towable on the road preferably with a truck.

The crusher 404 of the processing plant is preferably a cone crusher according to FIG. 1. The crusher 404 can preferably be located also to a fixed crushing plant.

The foregoing description provides non-limiting examples of some embodiments of the invention. It is clear to a person skilled in the art that the invention is not restricted to details presented, but that the invention can be implemented in other equivalent means. Some of the features of the above-disclosed embodiments may be used to advantage without the use of other features.

As such, the foregoing description shall be considered as merely illustrative of principles of the invention, and not in limitation thereof. Hence, the scope of the invention is only restricted by the appended patent claims.

The invention claimed is:

1. A cone crusher comprising:

a frame;

an outer blade which is adapted to be locked to the frame;

an inner blade which is eccentrically and vertically movable relative to the outer blade, wherein the inner blade and the outer blade define therebetween a crushing chamber;

a main shaft which is stationary relative to the frame, the main shaft including a hollow space;

an eccentric which is bearing-mounted on the main shaft;

a support cone on which the inner blade is arranged;

an adjustment shaft positioned in the hollow space of the main shaft and configured to support the support cone, wherein the adjustment shaft is vertically movable from below;

a load cylinder arranged to surround a lower end of the main shaft, wherein the load cylinder comprises an adjustment piston positioned on a lower end of the adjustment shaft;

a pressure medium supply arranged to supply a pressurized volume of the medium under the adjustment piston for moving vertically the adjustment shaft; and a lubricant supply arranged above the adjustment piston for directing lubricant through the hollow space between the main shaft and the adjustment shaft to targets to be lubricated, wherein the main shaft is fixed stationary to the frame such that the lower end of the main shaft extends outside the frame and under the frame and the lubricant supply is arranged from outside the frame to the extending part of the main shaft outside of the frame and through the main shaft to the hollow space.

2. The cone crusher according to claim 1, wherein the main shaft is fixed stationary to the frame such that the lubricant supply is arranged via the load cylinder.

3. The cone crusher according to claim 1, wherein the load cylinder comprises an adjustment valve and additionally an overload protection which is/are coupled directly in connection with the pressure volume of the load cylinder.

4. The cone crusher according to claim 1, wherein a thrust bearing is arranged between an upper end of the adjustment shaft and the support cone.

5. The cone crusher according, to claim 1, wherein an anti-spin brake is arranged between the upper end of the adjustment shaft and the support cone, inside the upper end of the adjustment shaft.

6. The cone crusher according to claim 1, wherein a locking means is arranged to the hollow space between the adjustment shaft and the main shaft which locking means allows the vertical movement of the adjustment shaft relative to the main shaft.

7. The cone crusher according claim 1, wherein flow channels and/or flow grooves are arranged to the main shaft (7), the adjustment shaft (14) and radial hearings comprised by the cone crusher for directing lubricant from the hollow space to the lubrication targets.

8. The cone crusher according to claim 1, wherein the load cylinder comprises a cylinder sleeve which is attached to the lower end of the main shaft and a cylinder chamber is formed in the cylinder sleeve inside walls of the cylinder, in which cylinder chamber the adjustment piston is adapted to be moved vertically, and the cylinder chamber is open to the hollow space above the adjustment piston and the cylinder sleeve is reduced in thickness from outside for supplying lubricant from outside the thinned cylinder sleeve to the hollow space.

9. The cone crusher according to claim 8, wherein the load cylinder comprises a cover which is closing the cylinder chamber under the adjustment piston, and a pressure medium supply channel is arranged to the cover.

10. The cone crusher according to claim 1, wherein the cone crusher comprises means for adjusting vertically the position of the outer blade relative to the frame.

11. The cone crusher according to claim 10, wherein the cone crusher comprises a thread for the vertical adjustment of the outer blade which thread comprises an inner thread arranged on side of the frame and an outer thread arranged on side of the outer blade and an angle of the cross section profile of the thread is selected such that contact surfaces of the inner and outer threads via which crushing force is transferred to the frame are perpendicular relative to a force resultant of the crushing event.

12. A mineral material processing plant comprising a feeder for feeding mineral, material to be crushed and a conveyor for transferring crushed material further and a crusher, which comprises:

a frame;

an outer blade which is adapted to be locked to the frame;

an inner blade which is eccentrically and vertically movable relative to the outer blade, wherein the inner blade and the outer blade define there between a crushing chamber;

a main shaft which is stationary relative to the frame, the main shaft including a hollow space;

an eccentric which is bearing-mounted on the main shaft;

a support cone on which the inner blade is arranged;

an adjustment shaft positioned in the hollow space of the main shaft and configured to support the support cone, wherein the adjustment shaft is vertically movable from below;

a load cylinder arranged to surround a lower end of the main shaft, wherein the load cylinder comprises an adjustment piston positioned on a lower end of the adjustment shaft;

a pressure medium supply arranged to supply a pressurized volume of the medium under the adjustment piston for moving vertically the adjustment shaft; and a lubricant supply arranged above the adjustment piston for directing lubricant through the hollow space between the main shaft and the adjustment shaft to targets to be lubricated, wherein the main shaft is fixed stationary to the frame such that the lower end of the main shaft extends outside the frame and under the frame and the lubricant supply is arranged from outside the frame to the extending part of the main shaft outside of the flume and through the main shaft to the hollow space.

13. The processing plant according to claim 12, wherein the processing plant is a fixed plant, an independent movable plant or a plant which is transportable on road.

* * * * *